US006752216B2

(12) United States Patent
Coon

(10) Patent No.: US 6,752,216 B2
(45) **Date of Patent: *Jun. 22, 2004**

(54) EXPANDABLE PACKER, AND METHOD FOR SEATING AN EXPANDABLE PACKER

(75) Inventor: Robert Joe Coon, Missouri City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 41 days.

This patent is subject to a terminal disclaimer.

(21) Appl. No.: 09/938,176

(22) Filed: Aug. 23, 2001

(65) Prior Publication Data

US 2003/0037931 A1 Feb. 27, 2003

(51) Int. Cl.[7] ..... E21B 33/12; E21B 33/129

(52) U.S. Cl. ..... 166/387; 166/382; 166/118; 166/181

(58) Field of Search ..... 166/387, 382, 166/115, 116, 118, 179, 181, 208, 250.17

(56) References Cited

U.S. PATENT DOCUMENTS

| | | | | |
|---|---|---|---|---|
| 761,518 A | | 5/1904 | Lykken | |
| 1,324,303 A | | 12/1919 | Carmichael | |
| 1,545,039 A | | 7/1925 | Deavers | |
| 1,561,418 A | | 11/1925 | Duda | |
| 1,569,729 A | | 1/1926 | Duda | |
| 1,597,212 A | | 8/1926 | Spengler | |
| 1,930,825 A | | 10/1933 | Raymond | |
| 1,981,525 A | | 11/1934 | Price | 166/4 |
| 2,214,226 A | | 9/1940 | English | 166/1 |
| 2,383,214 A | | 8/1945 | Prout | 153/82 |
| 2,499,630 A | | 3/1950 | Clark | 153/81 |
| 2,627,891 A | | 2/1953 | Clark | 153/82 |
| 2,663,073 A | | 12/1953 | Bieber et al. | 29/148 |
| 2,898,971 A | | 8/1959 | Hempel | 153/82 |
| 3,087,546 A | | 4/1963 | Wooley | 166/46 |
| 3,191,677 A | | 6/1965 | Kinley | 166/14 |
| 3,195,646 A | | 7/1965 | Brown | 166/208 |
| 3,208,531 A | * | 9/1965 | Tamplen | 166/125 |
| 3,467,180 A | | 9/1969 | Pensotti | 165/180 |
| 3,712,376 A | | 1/1973 | Owen et al. | 166/277 |
| 3,776,307 A | | 12/1973 | Young | 166/125 |
| 3,818,734 A | | 6/1974 | Bateman | 72/75 |
| 3,911,707 A | | 10/1975 | Minakov et al. | 72/76 |

(List continued on next page.)

FOREIGN PATENT DOCUMENTS

| | | | |
|---|---|---|---|
| EP | 0 961 007 A2 | 12/1999 | E21B/33/10 |
| GB | 887150 | 1/1962 | |
| GB | 2 216 926 | 10/1989 | E21B/7/20 |

(List continued on next page.)

OTHER PUBLICATIONS

U.S. patent application Ser. No. 09/938,168, Coon, filed Aug. 23, 2001.
U.S. patent application Ser. No. 09/904,735, Badrak et al., filed Jul. 13, 2001.

(List continued on next page.)

*Primary Examiner*—David Bagnell
*Assistant Examiner*—Daniel P Stephenson
(74) *Attorney, Agent, or Firm*—Moser, Patterson & Sheridan, L.L.P.

(57) ABSTRACT

The present invention provides an expandable packer, and methods for seating an expandable packer. The apparatus comprises an expandable seating body configure to receive a packer body. The seating body is tubular in configuration, and is run into a cased wellbore. The seating body is then set by expanding it into frictional contact with the inner surface of the casing. Thereafter, a packer body is lowered into the seating body. In this respect, the inner surface of the seating body is configured to receive the outer surface of the packer body. The expandable packer can then seal the annulus between one or more tubulars and the casing within the wellbore.

10 Claims, 6 Drawing Sheets

U.S. PATENT DOCUMENTS

| | | | | |
|---|---|---|---|---|
| 3,948,321 | A | 4/1976 | Owen et al. | 166/277 |
| 4,069,573 | A | 1/1978 | Rogers, Jr. et al. | 29/421 R |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,319,393 | A | 3/1982 | Pogonowski | 29/434 |
| 4,324,407 | A | 4/1982 | Upham et al. | 277/27 |
| 4,429,620 | A | 2/1984 | Burkhardt et al. | 91/395 |
| 4,531,581 | A | 7/1985 | Pringle et al. | 166/120 |
| 4,588,030 | A | 5/1986 | Blizzard | 166/120 |
| 4,697,640 | A | 10/1987 | Szarka | 166/120 |
| 4,848,469 | A | 7/1989 | Baugh et al. | 166/382 |
| 5,052,483 | A | 10/1991 | Hudson | 166/55 |
| 5,271,472 | A | 12/1993 | Leturno | 175/107 |
| 5,409,059 | A | 4/1995 | McHardy | 166/208 |
| 5,435,400 | A | 7/1995 | Smith | 175/61 |
| 5,472,057 | A | 12/1995 | Winfree | 175/57 |
| 5,560,426 | A | 10/1996 | Trahan et al. | 166/120 |
| 5,685,369 | A | 11/1997 | Ellis et al. | 166/195 |
| 5,901,787 | A | 5/1999 | Boyle | 166/135 |
| 6,021,850 | A | 2/2000 | Wood et al. | 166/380 |
| 6,029,748 | A | 2/2000 | Forsyth et al. | 166/380 |
| 6,098,717 | A | 8/2000 | Bailey et al. | 166/382 |
| 6,488,095 | B2 * | 12/2002 | Buytaert | 166/382 |

FOREIGN PATENT DOCUMENTS

| | | | |
|---|---|---|---|
| GB | 2 320 734 A | 7/1998 | E21B/33/127 |
| GB | 2 329 918 | 4/1999 | E21B/43/10 |
| GB | 2 345 308 | 7/2000 | E21B/43/10 |
| WO | WO 93/24728 | 12/1993 | E21B/17/10 |
| WO | WO 99/18328 | 4/1999 | E21B/23/01 |
| WO | WO 99/23354 | 5/1999 | E21B/43/10 |
| WO | WO 00/37773 | 6/2000 | E21B/43/10 |
| WO | WO 200037766 A2 * | 6/2000 | B21D/17/04 |
| WO | WO 200037767 A2 * | 6/2000 | B21D/17/04 |
| WO | WO 200037768 A1 * | 6/2000 | E21B/29/10 |
| WO | WO 200037772 A1 * | 6/2000 | E21B/43/10 |
| WO | WO 01/60545 A1 | 8/2001 | B21D/39/00 |

OTHER PUBLICATIONS

U.S. patent application Ser. No. 09/885,850, Lauritzen et al., filed Jun. 20, 2001.

U.S. patent application Ser. No. 09/818,119, Lauritzen, filed Mar. 27, 2001.

U.S. patent application Ser. No. 09/848,900, Haugen et al., filed May 4, 2001.

U.S. patent application Ser. No. 09/828,508, Simpson et al., filed Apr. 6, 2001.

U.S. patent application Ser. No. 09/470,176, Metcalfe et al., filed Dec. 22, 1999.

U.S. patent application Ser. No. 09/470,154, Metcalfe et al., filed Dec. 22, 1999.

U.S. patent application Ser. No. 09/469,692, Trahan, filed Dec. 22, 1999.

U.S. patent application Ser. No. 09/469,690, Simpson, filed Dec. 22, 1999.

U.S. patent application Ser. No. 09/469,681, Metcalfe et al., filed Dec. 22, 1999.

U.S. patent application Ser. No. 09/469,643, Metcalfe et al., filed Dec. 22, 1999.

U.S. patent application Ser. No. 09/469,526, Metcalfe et al., filed Dec. 22, 1999.

PCT International Search Report, International Application No. PCT/BG 02/03856, dated Jan. 2, 2003.

* cited by examiner

EXPANDABLE PACKER, AND METHOD FOR SEATING AN EXPANDABLE PACKER

BACKGROUND OF THE INVENTION

1. Field of the Invention

The present invention relates to the field of expandable downhole tools. More particularly, the present invention relates to an expandable packer having two separate components for isolating downhole areas within a wellbore. The present invention also relates to a method for seating a packer in a wellbore.

2. Description of Related Art

The use of packers for fluidly sealing portions of a wellbore is well known. Packers are most commonly used to isolate downhole formations by sealing the annular space between a production tubing and a wellbore casing. By sealing the annulus, hydrocarbon producing zones can be isolated from other regions within a wellbore, thereby preventing migration of formation fluid or pressure between zones or behind the production tubing.

Modern packers are typically set in a wellbore through fluid activation. The packer is lowered into the wellbore on the lower end of a tubular working string. Mud or other material is then pumped down the tubular under pressure. This fluid pressure activates a seal element which is expanded to engage the inner wall of the casing.

Packers typically comprise an expandable body having a hollow interior for defining an open flow path. The expandable body includes an inner elongated hollow mandrel with a hydraulic piston movably disposed upon the external surface of the mandrel. The piston is movable between an initial "running" position and a final "setting" position. An external sleeve is engaged by the piston when it moves between the running and setting positions. The external sleeve engages slips that expand to anchor the tool body to the well casing. A sealing element responsive to sliding movement of the external sleeve is positioned below the slips for forming a seal between the tool body and the casing at a position near the lower end portion of the tool body. The sealing element typically defines upper and lower retaining rings to fluidly seal the annulus between the tubing and the casing.

Technology for expanding packer elements against casing is disclosed in certain patents. U.S. Pat. No. 6,041,858 issued in 2000 to Arizmendi discloses a packer having two separate body sections, and a deformable material therebetween. The deformable material is extruded into the annular space between the tubing and the casing by application of a vertical force between the first and second body sections.

U.S. Pat. No. 4,753,444 to Jackson et al. (1988), discussed in the Arizmendi ('858) patent, discloses a packer having a conventional sealing element located around the outside of a mandrel. Anti-extrusion rings and back-up rings contain the seal element ends and are compressed to radially expand the seal element outwardly into contact with the well casing. Additional patents referenced include U.S. Pat. No. 4,852,649 to Young (1989), U.S. Pat. No. 5,046,557 to Manderscheid (1991), U.S. Pat. No. 5,096,209 to Ross (1992), U.S. Pat. No. 5,195,583 to Toon et al. (1993), and U.S. Pat. No. 5,467,822 to Zwart (1995).

One limitation found within conventional packers is the extent to which a secure seal can be obtained between the exterior sealing element and the interior of the casing. In this respect, a secure seal of the tubing-casing annulus is of utmost importance. As noted above, the seal is typically set through the application of fluid pressure against a piston. The effectiveness of the seal is limited by the amount of fluid pressure that can be safely applied to the packer within the working string. Thus, a need exists for a packer which can be sealed by the direct application of mechanical force on the sealing element and against the casing, without the need of fluid pressure.

An additional limitation found within conventional packers, and as noted in the Arizmendi ('858) patent, is that the exterior sealing element travels on the packer exterior from the well surface to the downhole location. When the packer is run thousands of meters into a wellbore, the packing seal abrasively contacts the interior surface of the casing. In some instances, the packing seal may be worn away from the packer sleeve. This failure may not be detected until the packer is set and the pressure containment of the isolated zone fails. Thus, a need exists for a packer which has a sealing section with a smaller outer dimension that can be run into the wellbore and then expanded. In this manner, the sealing element can be lowered into the wellbore with less abrasion of the exterior sealing element against the inner wall of the casing.

An additional disadvantage to the conventional packer is the limited diameter of the bore provided through the packer body. Those of ordinary skill in the art will appreciate that the through-opening within the inner elongated hollow mandrel defines an opening which is somewhat smaller than the interior of the casing. This creates a limitation to the size and quantity of material that can be run into the wellbore. Thus, a need also exists for a packer which accommodates a larger string of tubing, multiple strings of larger tubing, or additional electronic feedthroughs by a larger through-opening.

Accordingly, a need exists for an expandable packer that avoids the disadvantages cited above, and provides a reliable seal with the casing in the wellbore.

It is, therefore, one of the many objects of the present invention to provide a novel packer having an expandable seating body which provides a more secure fluid seal, with the seal being created by the direct application of mechanical force to the seating element against the casing.

Still further, an object of the present invention is to provide a packer body which is seated onto a seating body after the seating body has been expanded and set within the casing. In this manner, a packer body having a larger through-opening may be utilized so as to accommodate additional or larger tools therethrough.

An additional object of the present invention is to provide a packer having a seating body which is dimensioned to reduce the risk of abrasion between the sealing element and the interior casing as the seating body is run into the wellbore.

Additional objects and advantages will become apparent from the detailed description of the invention, below.

SUMMARY OF THE INVENTION

The present invention provides an expandable packer, and a method for seating an expandable packer within a cased wellbore.

The apparatus of the present invention first comprises an expandable seating body. The seating body is tubular in configuration, and is run into a cased wellbore at the lower end of a string of tubulars. The seating body is releasably connected to an expander tool. At the appropriate depth, the expander tool is activated so as to expand a portion of the seating body into contact with the casing. The connection between the expander tool and the seating body is then released. The expander tool can then be reciprocated in a rotational and vertical fashion so as to expand the entire seating body into a frictional connection with the cemented casing.

After the seating body is expanded into position, the expander tool is removed from the wellbore. A packer body is then run into the hole where it is seated onto the seating body. The inner surface of the seating body is dimensioned to receive the packer body therein.

It is one purpose of the expandable packer to provide a fluid seal between the tubing-casing annulus within a wellbore. In this manner, zones within a wellbore can be isolated. To facilitate the isolation between zones, one or more sealing elements is provided on the outer surface of the seating body. This sealing element is circumferentially fitted onto the outer surface of the seating body. The sealing element makes contact with the casing when the seating body is expanded.

In addition, one or more packer seals is provided on the packer body. The packer seals are fitted around the outer surface of the packer body. Packer seals may include chevrons, o-rings, t-seals, or bonded rubber seals, and others, and are received within and make contact with the inner surface of the seating body when the packer body is landed into the seating body.

In one aspect, the inner surface of the seating body is profiled so as to receive dogs located on the outer surface of the packer body. This provides a means for landing the packer body within the seating body. This also facilitates the removal of the run-in string without also pulling the packer body. In this respect, a shearable or other releasable connection is employed between the run-in string and the packer body so as to allow the packer body to be released from the run-in string once the packer body is seated.

In one embodiment of the method of the present invention, the packer body is run into the wellbore along with the seating body and the expander tool in a single trip.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
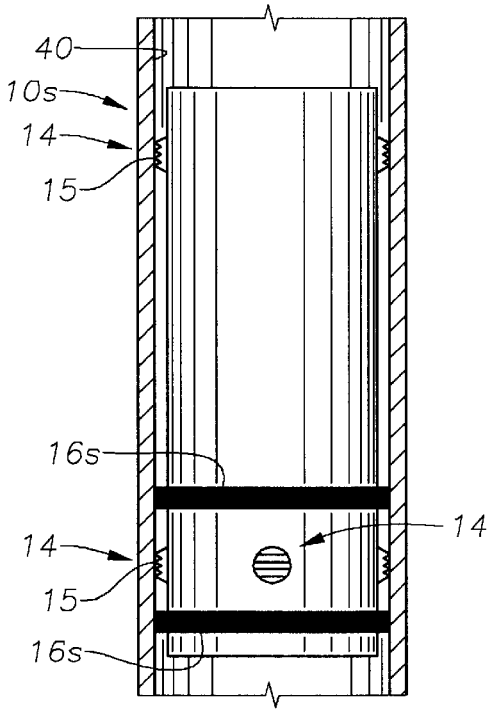
FIG. 1 is a front view of the seating body of the present invention, in contact with the inner wall of the casing of a wellbore.

FIG. 1 is a schematic view of the front of the seating body 10*s* of the present invention. The seating body 10*s* defines a tubular apparatus concentrically fitted within casing 40 of a wellbore. This necessarily means that the outer diameter of the seating body 10*s* is less than the inner diameter of the casing 40.

In order to fulfill the sealing function of the expandable packer 10 of the present invention, one or more sealing elements 16*s* are provided on the outer surface of the seating body 10*s*. This sealing element 16*s* is preferably an elastomeric material circumferentially fitted onto the outer surface of the seating body 10*s*. The sealing element 16*s* makes contact with the casing 40 when the seating body 10*s* is expanded. In FIG. 1, the sealing element 16*s* is shown to be expanded so that a fluid seal is established between the sealing element 16*s* and the casing 40.

The seating body 10*s* optionally includes slips 14 which engage the casing 40. In the preferred embodiment, a plurality of slips 14 are disposed along the outer surface of the seating body 10*s*. The slips 14 define buttons having teeth 15 for gripping the inner surface of the casing 40, thereby providing further friction between the seating body 10*s* and the casing 40. The slips 14 may be of any shape, and may even define a contiguous ring (not shown) around the outside surface of the seat 10. In one aspect, the teeth 15 of the slips 14 are fabricated from a carbide material. It is within the scope of this invention 10 to utilize slips of other forms and materials, such as an array of teeth (not shown) helically machined into the outer surface of the seat 10, or no slips at all.

Figure 2:
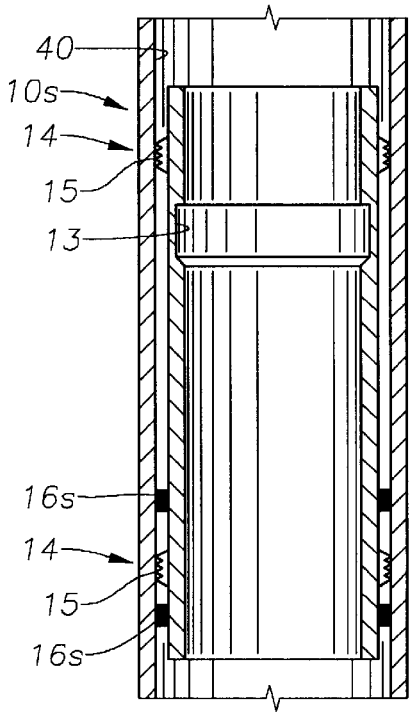
FIG. 2 is a sectional view of a seating body of the present invention, in contact with the inner wall of the casing of a parent wellbore.

FIG. 2 is a sectional view of a seating body 10*s* of the present invention. In both FIG. 1 and FIG. 2, the seating body 10*s* is shown to be expanded so that the slips 14 are in contact with the inner wall of the casing 40. Thus, a friction fit is established between the outer surface of the seating body 10*s* and the inner surface of the casing 40. The seating body 10*s* essentially defines an expandable body portion and a profile 13 therein for receiving another tool. Profile 13 is shown as a ring within the inner surface of the seating body 10*s* in FIG. 2.

Figure 8:
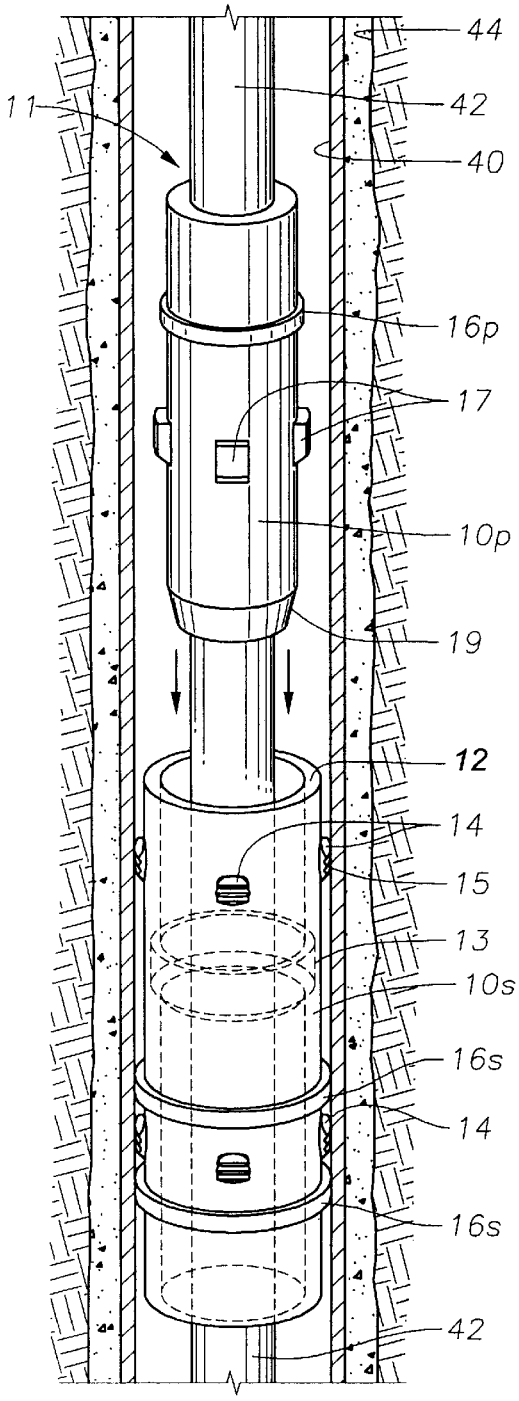
FIG. 8 is a perspective view of a packer body being run into a wellbore, and being positioned for seating into a seating body of the present invention. In this view, the seating body has been expanded into contact with the casing.

The seating body 10*s* is designed to serve as a landing for a packer body 10*p*, shown in FIG. 8. To accomplish this purpose, the inner diameter of the seating body 10*s* is dimensioned to receive the packer body 10*p*. The inner surface of the seating body 10*s* is profiled so as to receive dogs 17 disposed along the outer surface of the packer body 10*p*. Dogs 17 are received within profile ring 13 of the seat 10*s*.

Figure 3:
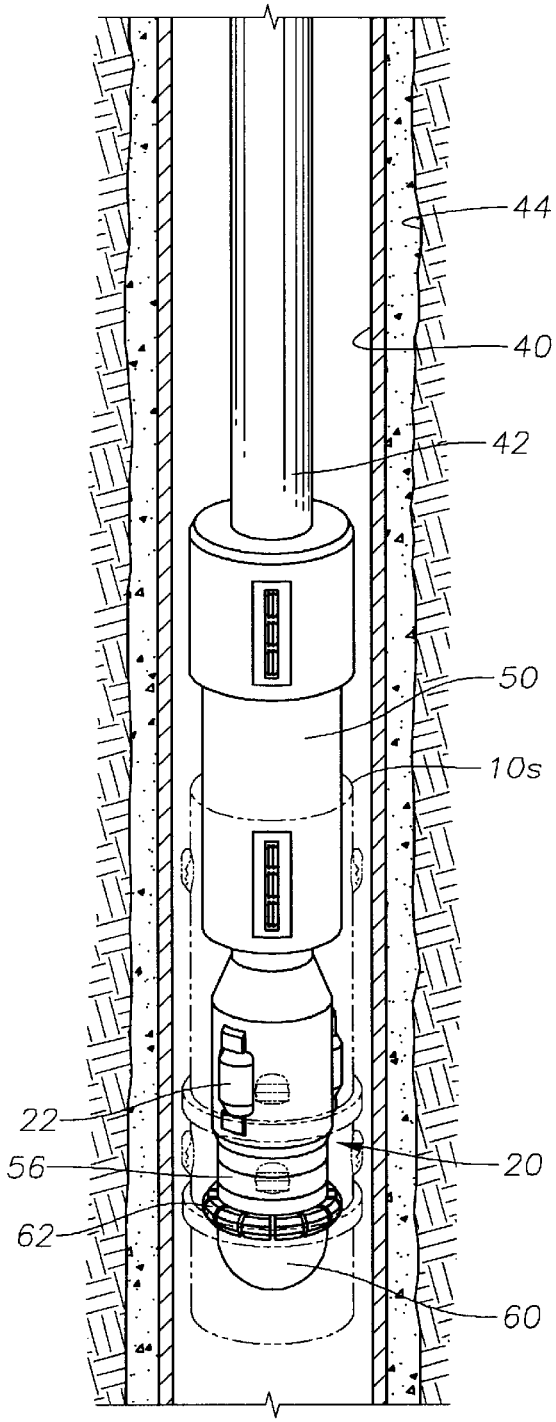
FIG. 3 is a perspective view of a seating body of the present invention, in phantom. The seating body is within a wellbore, and is releasably connected to an expander tool. In this view, the expander tool has not yet been activated to expand the seating body.

The seating body 10*s* is lowered into the wellbore 44 on a tubular string 42 such as jointed tubing or coiled tubing. FIG. 3 presents a seating body 10*s* of the present invention 10 positioned at the lower end of a working tubular 42. In this figure, the seating body 10*s* is presented in phantom.

Figure 4:
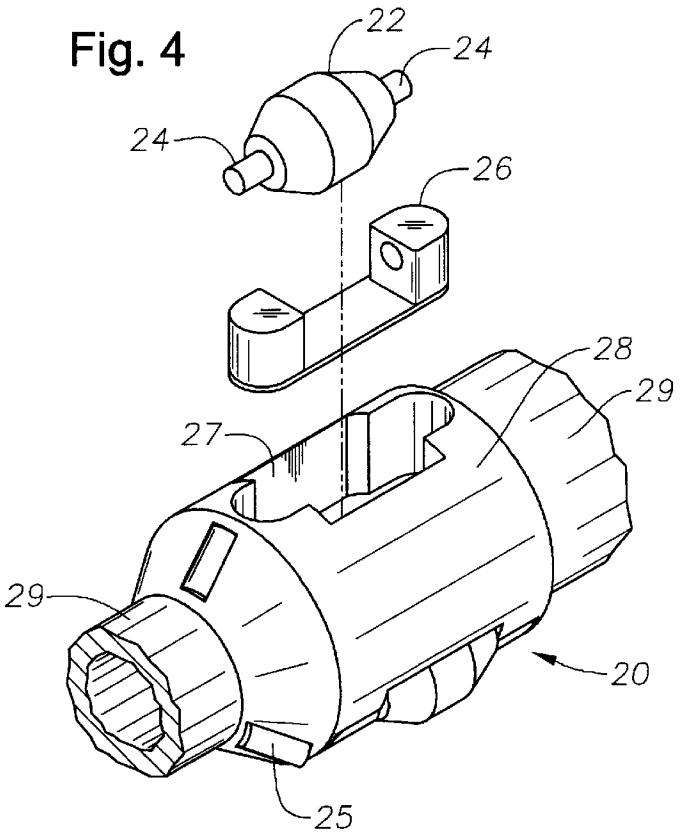
FIG. 4 is an exploded view of an expander tool as might be used to expand a seating body of the present invention.

FIG. 3 also presents an expander tool 20, to be used in expanding the seating body 10*s*. The expander tool 20 is more fully shown in FIG. 4, which is an exploded view of an exemplary expander tool 20. In one aspect, the expander tool 20 has a body 28 which is hollow and generally tubular with connectors 29 for connection to other components (not shown) of a downhole assembly. The connectors 29 are of a reduced diameter compared to the outside diameter of the longitudinally central body part 28 of the tool 20. The central body part 28 has three recesses 27 to hold a respective roller 22. Each of the recesses 27 has parallel sides and extends radially from a radially perforated tubular core (not shown) of the tool 20. Each of the mutually identical rollers 22 is somewhat cylindrical and barreled. Each of the rollers 22 is mounted by means of an axle 24 at each end of the respective roller and the axles are mounted in slidable pistons 26. The rollers 22 are arranged for rotation about a respective rotational axis which is parallel to the longitudinal axis of the tool 20 and radially offset therefrom at 120-degree mutual circumferential separations around the central body 28. The axles 24 are formed as integral end members of the rollers and the pistons 26 are radially slidable, one piston 26 being slidably sealed within each radially extended recess 27. The inner end of each piston 26 is exposed to the pressure of fluid within the hollow core of the tool 20 by way of the tubular 42. In this manner, pressurized fluid provided from the surface of the well, via the tubular 42, can actuate the pistons 26 and cause them to extend outward whereby the rollers 22 contact the inner surface of the seating body 10*s* to be expanded.

Figure 5:
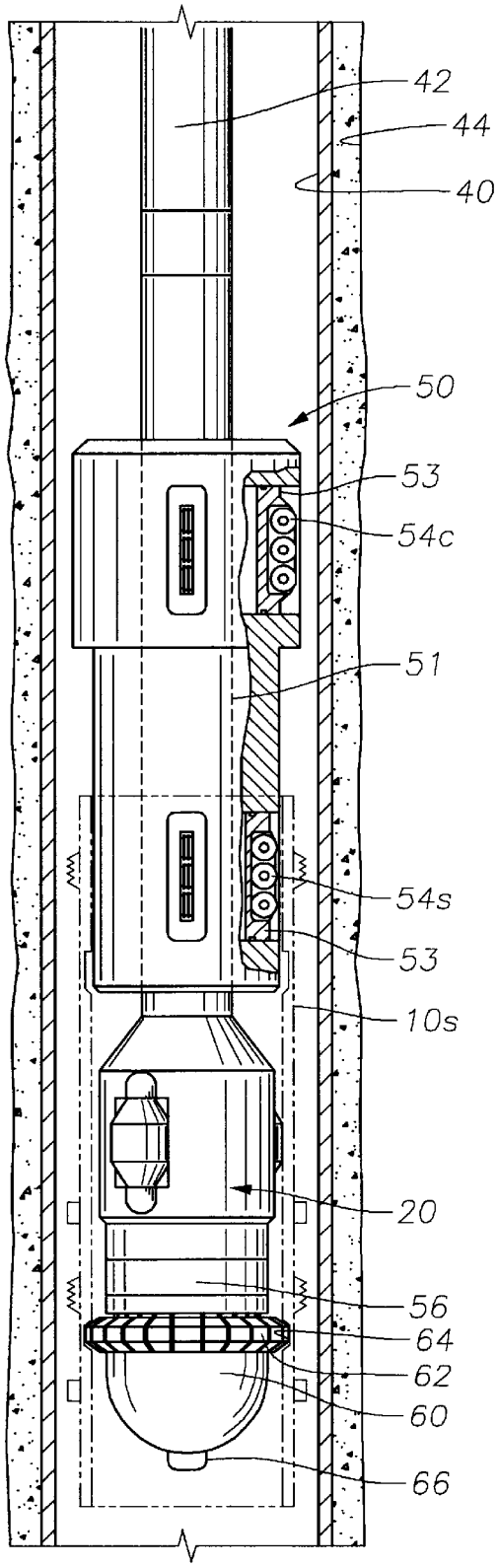
FIG. 5 is a schematic view of the expander tool connected to the seating body of the present invention in a downhole position. A retractable collet is employed for a releasable connection between the expander tool and the seating body. In addition, a torque anchor is shown to stabilize the seating body during expansion.
Figure 6:
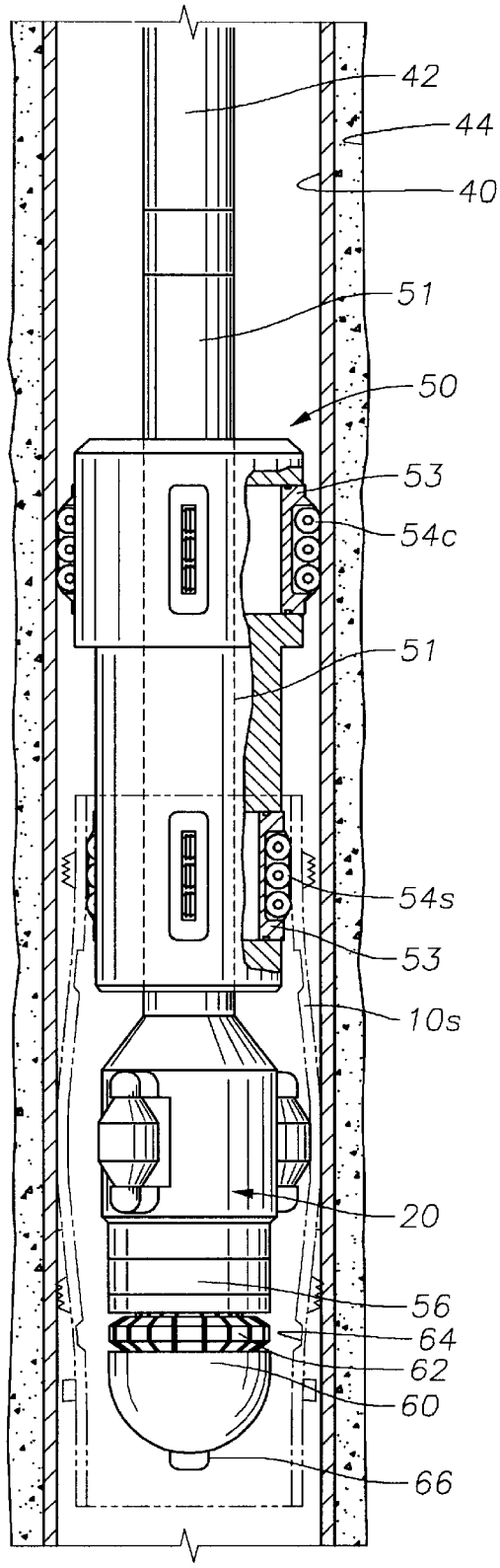
FIG. 6 is a side view of the expander tool and seating body of FIG. 8, with the collet in its retracted position, and with the torque anchor in its set position.

In the perspective view of FIG. 3, the expander tool 20 has not yet been activated to expand the seating body 10*s*. The expander tool 20 is held to the seating body 10*s* by at least one releasable connection 62. In one embodiment, the releasable connection is shearable, and defines a pin (not shown) connected to the seating body 10*s*, such as by welding. However, in the embodiment shown in FIG. 3, a collet 62 is utilized below the expander tool 20. The collet 62 is affixed to a nipple 60, as shown in FIGS. 5 and 6. In one embodiment, shown in the perspective view of FIG. 8, the collet 62 is an elastomeric ring which encircles the nipple 60, and resides in a collet profile 64 formed within the inner surface of the seat 10*s*. This arrangement provides more secure support for the seating body 10*s* on the expander tool 20 as it is run into the hole 44. Those of ordinary skill in the art will appreciate that a shearable pin could become sheared while the expander tool 20 is being run into the wellbore 44, causing the seat 10*s* to fall to the bottom of the wellbore 44. A swivel 56 allows the expander tool 20 to rotate while the collet 62 continues to engage and support the seat 10.

The nipple 60 includes a nozzle 66. The nozzle 66 serves as an outlet through which fluid may be circulated. The nozzle 66 defines a sized orifice by which pumped fluid can reach critical flow. Once critical flow is reached, pressure builds within the expander tool 20 for activation of the rollers 22.

At the appropriate depth, and while the collet 62 continues to support the seat 10, the expander tool 20 is activated so as to expand a portion of the seating body 10*s* into contact with the casing 40. The expander tool 20 is then rotated so as to release the connection between the expander tool 20 and the seat 10*s*, and to create complete radial contact between a portion of the seat 10 and the casing 40. Expansion of a portion of the casing 40 at the initial depth of the expander tool 20 will cause the seat 10*s* to release the collet 62, such that the collet 62 is no longer affixed within the collet profile 64. The expander tool 20 can then be reciprocated in both a rotational and vertical fashion so as to expand the entire seat 10 into a frictional connection with the cemented casing 40.

It is within the scope of the invention to provide a collet 62 which is capable of being mechanically retracted from the collet profile 64. In this respect, the collet 62 would be released via mechanical switch, or via release of pressure from a fluid line, or other means (not shown) known in the art for releasing a collet 62. Thus, the collet 62 would be retracted from the collet profile 64 at the time an initial portion of the seat 10*s* is expanded into contact with the inner surface of the casing 40.

It is further within the scope of this invention to provide a shear pin or other releasable connection (not shown) between the expander tool 20 and the seat 10 in lieu of or in addition to a collet. Where a shearable pin is used, rotation of the expander tool 20 serves to release the connection between the expander tool 20 and the seat 10. The expander tool 20 is also reciprocated in a rotational and vertical fashion so as to expand the entire seat 10 into a frictional connection with the cemented casing 40.

As a further aid in the expansion of the seating body 10*s*, a torque anchor 50 may be utilized. The torque anchor 50 is designed to prevent the seat 10 from rotating while the expander tool 20 acts against the seat 10*s*. The torque anchor 50 defines a body having sets of wheels 54*c* and 54*s* radially disposed around its perimeter. The wheels 54*c* and 54*s* reside within wheel housings 53, and are oriented to permit axial (vertical) movement, but not radial movement, of the torque anchor 50. Sharp edges (not shown) along the wheels 54*c* and 54*s* aid in inhibiting radial movement of the torque anchor 50. In the preferred embodiment, four sets of wheels 54*c* and 54*s* are employed to act against the casing 40 and the seating body 10*s*, respectively.

The torque anchor 50 is run into the wellbore 44 on the working string 42 along with the expander tool 20 and the seating body 10*s*. The run-in position of the torque member 50 is shown in FIG. 5. In this position, the wheel housings 53 are maintained essentially within the torque anchor body 50. Once the seating body 10*s* is lowered to the appropriate depth within the wellbore 44 and oriented, the torque anchor 50 is activated. Fluid pressure provided from the surface through the working tubular 42 acts against the wheel housings 53 to force the wheels 54*c* and 54*s* from the torque anchor body 50. Wheels 54*c* act against the inner surface of the casing 40, while wheels 54*s* act against the inner surface of the seat 10. This activated position is depicted in FIG. 6.

Figure 7:
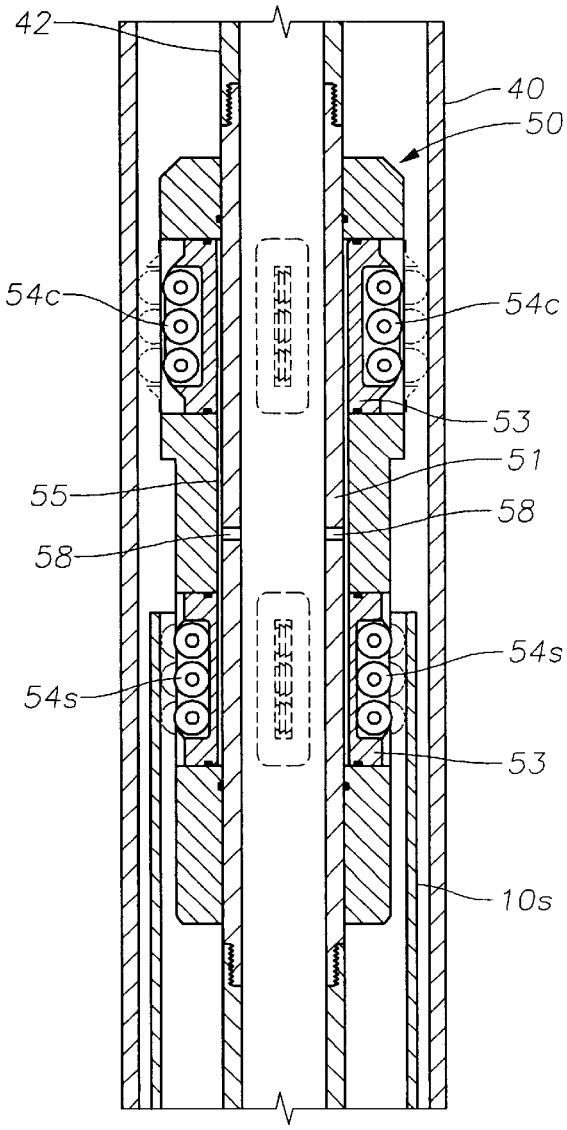
FIG. 7 is a cross-sectional view of a torque anchor in its retracted position.

FIG. 7 presents a cut-away view of the torque anchor 50. The extended position of the wheels 54*c* and 54*s* is shown in phantom. Visible within the cut-away is a rotating sleeve 51 which resides longitudinally within the torque anchor 50. The sleeve 51 rotates independent of the torque anchor body 50. Rotation is imparted by the working tubular 42. In turn, the sleeve 51 provides the rotational force to rotate the expander tool 20.

An annular space 55 exists between the sleeve 51 and the wheel housings 53. Through-openings 58 reside within the sleeve 51 which allow fluid to enter the annular space 55 and act against the wheel housings 54. The wheel housings 53, in turn, extrude from the torque anchor body 50 and grip the casing 40 and seat 10, respectively, to prevent rotation during initial expansion of the seating body 10*s*. It will be appreciated that the initial vertical movement of the expander tool 20 will need to be upward. This is because the size of the torque anchor 50 will prevent the expander tool 20 from moving downward until after the upper portions of the seat 10 have been expanded. As the expander tool 20 is raised, the seat wheels 54*s* on the torque anchor 50 clear the top of the seat 10. By that time, however, the seating body 10*s* is sufficiently expanded to prevent rotation with the expander tool 20. Once the upper portions of the seat 10*s* have been expanded, the expander tool 20 is lowered so that the lower portions of the seat 10*s* can also be expanded.

After the seating body 10*s* has been completely expanded into frictional contact with the inner wall of the casing 40, the expander tool 20 is deactivated. In this regard, fluid pressure supplied to the pistons 26 is reduced or released, allowing the pistons 26 to return to the recesses 27 within the central body part 28 of the tool 20. The expander tool 20 can then be withdrawn from the wellbore 44 by pulling the working tubular 42. The wellbore 44 is then ready to receive the packer body 10*p*.

After the seat 10*s* is expanded along its length, a packer body 10*p* is run into the wellbore 44. FIG. 8 is a perspective view of a packer body 10*p* being run into a wellbore 44, and being positioned for seating into a seating body 10*s* of the present invention. In this view, the seating body 10*s* has been expanded into contact with the casing 40. In the preferred embodiment, the packer body 10*p* is a resilient member such as, for example, of a steel or composite construction. In the preferred embodiment, the packer body 10*p* includes an elongated tubular inner mandrel defining a polished inner bore 11.

The packer body 10*p* is run into the wellbore 44 on a tubular 42. The tubular 42 again may be a jointed tubing or coiled tubing or other working string. Typically, the run-in tubular for the packer body 10*p* is the production tubing, shown as 42 in FIG. 8 and as 42' in FIGS. 9 and 10. The packer body 10*p* has a top end 18 and a bottom end 19. At least the top end 18 is connected to the tubular 42. As shown in the embodiment of FIG. 8, the packer body 10*p* is in series with the production tubular 42 such that the tubular 42 is connected to the packer body 10*p* at both the top 18 and bottom 19 ends of the packer body 10*p*. In this embodiment, the tubular string 42 and the inner bore 11 are in fluid communication.

As the packer body 10*p* is lowered into the wellbore 44, the packer body 10*p*comes into contact with the positioned seat 10*s*. The lower end 19 of the packer body 10*p* may optionally be beveled, as shown in FIG. 8, to aid the landing of the packer body 10*p* into the seating body 10*s*. As noted in connection with FIG. 2, the inner surface of the seating body 10*s* is profiled 13 so as to receive dogs 17 located on the outer surface of the packer body 10*p*. Dogs 17 are configured to land in profile ring 13 within the inner surface of the seating body 10*s*. The dogs 17 are biased to extend outward from the seating body 10*s*, but are capable of retracting to a first recessed position along the plane of the seating body 10*s* when the dogs 17 come into contact with the profile 13. In this manner, the dogs 17 will recess upon contact with top end 12, but then pop into place within the profile 13 once the packer body 10*p* lands fully into the seating body 10*s*. This provides a means for landing the packer body 10*p* within the seating body 10*s*.

An additional feature of the packer body 10*p* of the present invention is the use of one or more packer seal members 16*p*. One seal member 16*p* is depicted the perspective view of FIG. 8. The seal member 16*p* is circumferentially attached to the packer body 10*p* along its outer surface, thereby providing a fluid seal between the packer body 10*p* and the seating body 10*s* after the packer body 10*p* has been landed into the seat 10*s*. The packer seal members 16*p* are preferably fabricated from an elastomeric or other suitable material to facilitate the fluid seal with the seating body 10*s*. Packer seals 16*p* may include chevrons, O-rings, t-seals, bonded rubber seals, and others types of seals. At least a portion of the inner surface of the seating body 10*s* will be polished to facilitate a sealed connection with the packer sealing elements 16*p*.

Figure 9:
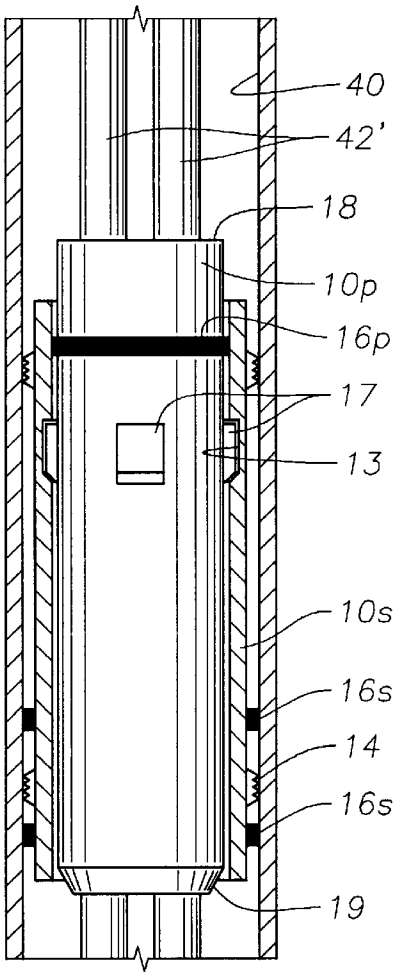
FIG. 9 is a schematic view of a packer body landed into a seating body of the present invention. In this embodiment, two strings of production tubing are placed through the packer body.

FIG. 9 is a schematic view of a packer body 10*p* landed into a seating body 10*s* of the present invention. Typically, the packer body 10*p* is made up with the production tubing 42' and run into the wellbore 44. In the embodiment shown in FIG. 9, two strings of production tubing 42' are placed through the packer body 10*p*. The packer body 10*p* is then run into the wellbore 44 and landed onto the seat 10*s*.

Figure 10:
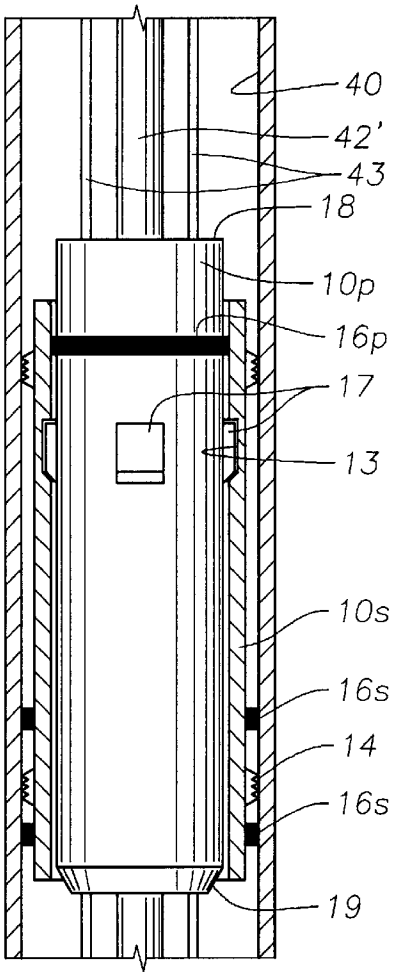
FIG. 10 is another schematic view of a packer body landed into a seating body of the present invention. In this embodiment, one string of production tubing is utilized, and two feed-through lines are set through the packer body.

FIG. 10 is another schematic view of a packer body 10*p* landed into a seating body 10*s* of the present invention. In this embodiment, one string of production tubing 42' is utilized, and two feed-through lines 43 are set through the packer body 10*p*. FIGS. 9 and 10 demonstrate that the expandable packer apparatus 10 of the present invention provides a greater proportion of useable diameter for running downhole tubulars than the conventional packer.

As the foregoing demonstrates, the present invention provides a novel, expandable seating body 10*s* for landing a packer body 10*p*. A novel method for seating a packer is also disclosed. In this respect, an expandable seat 10*s* is run into a cased wellbore 44. The seat 10 in one aspect is lowered into the wellbore 44 at a desired depth, along with an expander tool 20. The expander tool 20 is activated so as to expand the seat 10*s* along its entire longitudinal length. The seat 10*s* is thereby frictionally set within the inner surface of the casing 40. The expander tool 20 is removed from the wellbore 44, and a packer body 10*p* is then lowered therein. As the packer body 10*p* is run into the hole 44, it enters the seating body 10*s*. Dogs 17 disposed around the outer surface of the packer body 10*p* land in a profile ring 13 provided within the inner surface of the seating body 10*s*.

Figure 11:
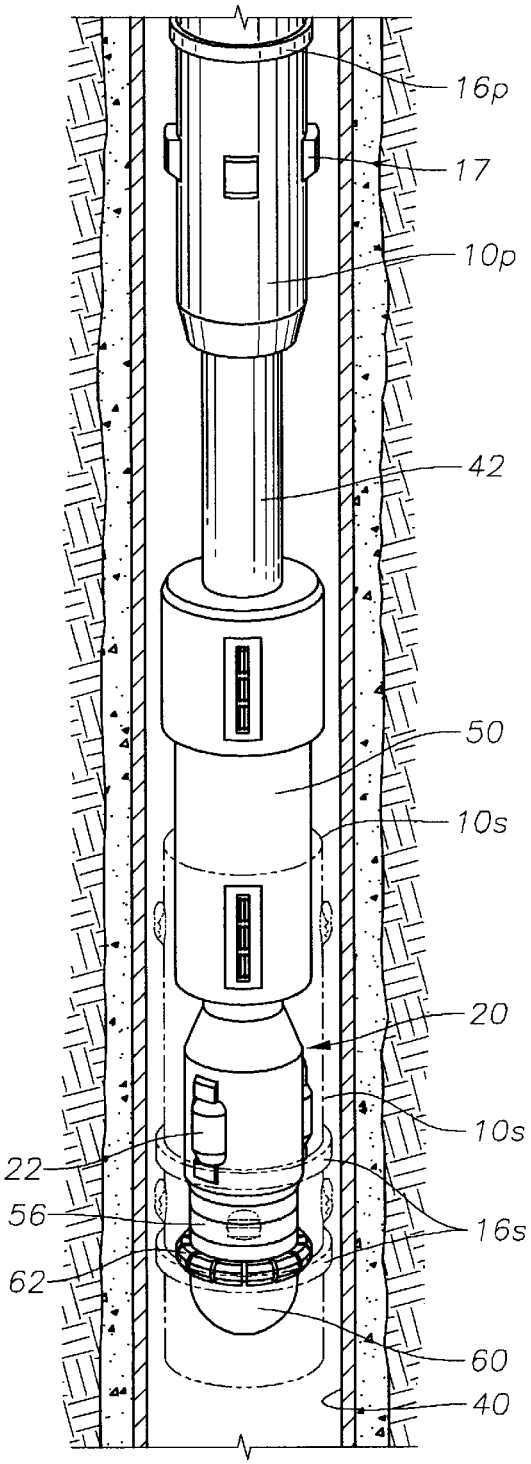
FIG. 11 is a perspective view of a seating body of the present invention, in phantom, for setting in a single trip. The seating body is within a wellbore, and is releasably connected to an expander tool. Present also in the tubular string is a packer body. In this view, the expander tool has not yet been activated to expand the seating body.

In another embodiment of an expandable packer, and method for seating a packer, an expandable seating body 10*s* is lowered into the wellbore 44, releasably connected to an expander tool 20. Above the expander tool 20, and within the same working string 42, is a packer body 10*p*. This arrangement is shown in FIG. 11. In this view, the expander tool 20 has not yet been activated to expand the seating body 10*s*.

Figure 12:
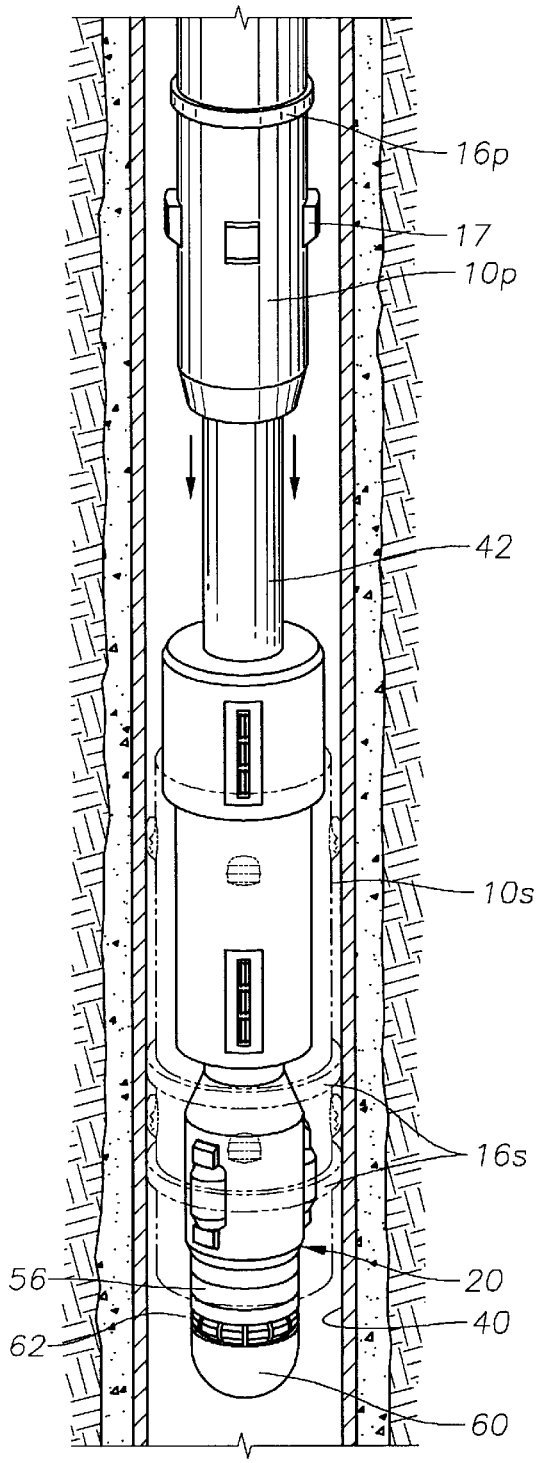
FIG. 12 is a perspective view of a seating body of FIG. 11. In this view, the expander tool has been activated to expand the seating body.

The expander tool 20 acts to expand the seating body 10*s* in accordance with the methods disclosed above. The working string 42 or, optionally, production tubing 42' is then lowered further into the wellbore 44 with the expander tool 20 still attached. This step is demonstrated in the perspective view of FIG. 12.

Figure 13:
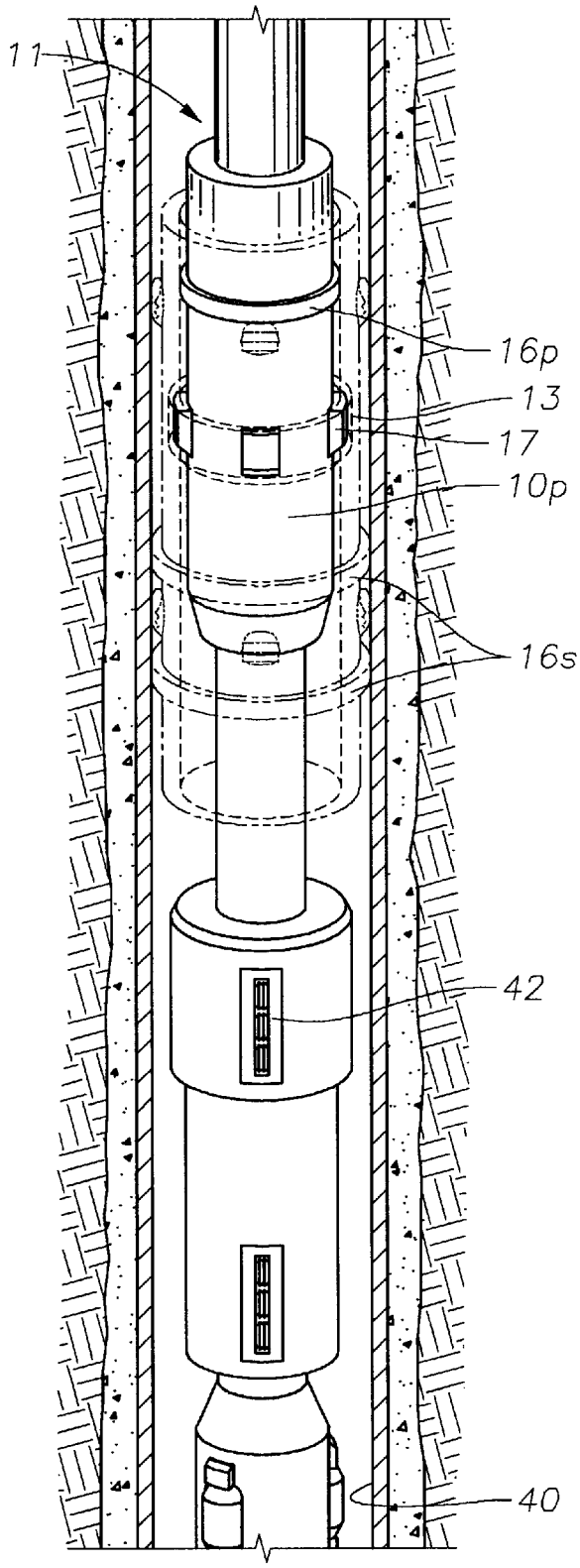
FIG. 13 is a perspective view of a seating body of FIG. 12. In this view, the packer body has been landed into the seating body. The expander tool will remain in the wellbore below the packer body.

As shown in FIG. 13, the packer body 10*p* is lowered into the wellbore 44 until the packer body 10*p* lands into the seating body 10*s*. The expander tool will remain in the wellbore 44 below the packer body 10*p*.

What is claimed is:

1. A packer for sealing an annular space between a tubular string and a cased wellbore, the packer comprising:

a seating body having an inner surface and an outer surface, said seating body being tubular in configuration, and said seating body being fabricated from an expandable material; and a packer body comprising a top end, a bottom end, and an outer surface, said top end being connected to the tubular string, and said outer surface being dimensioned to be received within said inner surface of said seating body after said seating body has been expanded into contact with the cased wellbore; and the packer body comprising at least one dog located along said outer surface of said packer body, said at least one dog capable of moving from a first extended position external to said plane of said outer surface, to a second recessed position along said plane of said outer surface, said at least one dog being biased in said extended position; and the seating body comprising at least one profile located on said inner surface of said seating body to correspond with said at least one dog, said at least one profile dimensioned to receive said at least one corresponding dog so as to further secure said packer body within said seating body.

2. The packer of claim 1 further comprising at least one sealing element along said outer surface of said seating body for providing a fluid seal between said outer surface of said seating body and the inner surface of the cased wellbore when said seating body is expanded.

3. The packer of claim 2 wherein each of said at least one sealing element of said seating body is fabricated from an elastomeric material, and is circumferentially fitted along said outer surface of said seating body.

4. The packer of claim 3 wherein said packer body further comprises an inner bore in fluid communication with said tubular string.

5. The packer of claim 4 further comprising a plurality of slips positioned on said outer surface of said seating body for contacting the inner surface of the casing when said seating body is expanded.

6. The packer of claim 5 further comprising at least one sealing element along said outer surface of said packer body for providing a fluid seal between said outer surface of said packer body and said inner surface of said seating body.

7. The packer of claim 6 wherein each of said at least one sealing element of said packer body is circumferentially fitted along said outer surface of said packer body.

8. The packer of claim 1, further comprising at least one releasable connection between said seating body and an expander tool such that said seating body and the expander tool may be run into the cased wellbore together.

9. A packer for sealing an annular space in a cased wellbore, the cased wellbore having an inner surface along the casing, and the packer comprising:

an expandable seating body having an inner surface and an outer surface, said seating body being tubular in configuration;

a packer body having a top end, a bottom end, and an outer surface, said top end being connected to said tubular string, and said outer surface being dimensioned to be received within said inner surface of said seating body after said seating body has been expanded against said cased wellbore;

at least one sealing element along said outer surface of said seating body for providing a fluid sealing between said outer surface of said seating body and the inner surface of the cased wellbore when said expandable body is expanded;

a plurality of slips positioned on said outer surface of said seating body for contacting the inner surface of the casing when said seating body is expanded;

at least one dog located along said outer surface of said packer body, said at least one dog capable of moving from a first extended position external to said plane of said outer surface, to a second recessed position along said plane of said outer surface, said at least one dog being biased in said extended position;

at least one profile located on said inner surface of said seating body to correspond with said at least one dog, said at least one profile dimensioned to receive said at least one corresponding dog so as to further secure said packer body within said seating body; and at least one sealing element along said outer surface of said packer body for providing a fluid sealing between said outer surface of said packer body and said inner surface of said seating body.

10. A method for setting a packer within a cased wellbore, and the expandable packer comprising:

an expandable seating body having an inner surface and an outer surface, said seating body being tubular in configuration;

a packer body having an outer surface, said outer surface being dimensioned to be received within said inner surface of said seating body after said seating body has been expanded;

at least one sealing element along said outer surface of said seating body for providing a fluid seal between said outer surface of said seating body and the inner surface of the cased wellbore when said expandable body is expanded; and a plurality of slips positioned on said outer surface of said seating body for contacting the inner surface of the casing when said seating body is expanded; and at least one sealing element along said outer surface of said packer body for providing a fluid seal between said outer surface of said packer body and said inner surface of said seating body;

the method comprising the steps of:

releasably attaching the expandable seating body to an expander tool; running the expandable seating body and the expander tool to a selected depth within the wellbore;

activating the expander tool so as to expand a portion of the expandable seating body into contact with the inner surface of the casing;

reciprocating the expander tool within the expandable seating body so as to release the releasable connection therebetween, and so as to expand the plurality of slips and the sealing element of the expandable seating body into contact with the inner surface of the casing;

removing the expander tool from the wellbore; and lowering the packer body into the wellbore until the packer body is seated in the seating body.

* * * * *